US005228364A

United States Patent [19]

Casas

[11] Patent Number: 5,228,364

[45] Date of Patent: Jul. 20, 1993

[54] APPARATUS FOR THE CONTROLLED RELEASE OF AN ELEVATOR HOIST BRAKE

[76] Inventor: Alan V. Casas, P.O. Box 327, Lake Isabella, Calif. 93240

[21] Appl. No.: 778,330

[22] Filed: Oct. 16, 1991

[51] Int. Cl.[5] ..... B25B 33/00

[52] U.S. Cl. ..... 81/485; 81/486

[58] Field of Search ..... 29/267, 278, 238-139; 269/236, 147, 150, 258-263, 268-271, 279, 283; 81/484-488

[56] References Cited

U.S. PATENT DOCUMENTS

| | | | |
|---|---|---|---|
| 48,431 | 6/1865 | Peace | 269/261 |
| 2,551,880 | 5/1951 | Gressley | 269/236 |
| 3,249,351 | 5/1966 | Smith | 269/236 |
| 4,516,423 | 5/1985 | Reich | 269/258 X |

FOREIGN PATENT DOCUMENTS

| | | | |
|---|---|---|---|
| 373849 | 3/1907 | France | 269/236 |
| 0648519 | 1/1951 | United Kingdom | 269/150 |

*Primary Examiner*—D. S. Meislin

*Attorney, Agent, or Firm*—Timothy T. Tyson

[57] ABSTRACT

Apparatus (20) is provided to enable a single operator to effect a controlled release of an elevator hoist brake (32) thus allowing "drifting" of the elevator car to the nearest floor and quick safe rescue of trapped passengers during an electrical outage. Other apparatus (120, 130) is provided which may be combined with elements of the apparatus 20 to release brakes on special types of elevators. An additional arrangement (20') of the apparatus 20 is provided to release brakes on still other special types of elevators. An observer having the elevator car in view may communicate (e.g. by hand held transceiver) desired car movements to the operator who is typically located in the machine room atop the elevator shaft.

10 Claims, 5 Drawing Sheets

APPARATUS FOR THE CONTROLLED RELEASE OF AN ELEVATOR HOIST BRAKE

TECHNICAL FIELD

The present invention pertains to elevator hoist brakes and, more particularly, to apparatus for the controlled release thereof.

BACKGROUND ART

Passenger elevators are typically raised or lowered by a cable running over a pulley at the top of an elevator shaft. A counterweight that balances the weight of the elevator car plus an average number of passengers is disposed at one end of the cable while the elevator car is attached to the other end. The car and counterweight run up and down the shaft on guide rails. An electric motor drives the pulley to move the car, needing only enough power to raise the difference in weight between car and passengers and the counterweight. The car is held at a floor by a hoist brake associated with the electric motor. The brake is typically urged on by springs and released by a solenoid. Thus an absence of electrical power sets the brake.

Electrical power outages safely brake the car at its position in the shaft but this situation may leave passengers trapped inside the car until rescue personnel can open shaft doors and extend ladders or ropes down to the car top. This effort can often require the efforts of several people. If the power outage is due to a natural catastrophe such as an earthquake it may be a considerable time before a sufficient number of rescue personnel are available. Apparatus that would allow a single person to effect a controlled release of the hoist brake and subsequent movement of the car could facilitate the prompt rescue of such people.

Special purpose apparatus has been developed for a variety of purposes such as the manual release mechanism for a spring-applied parking brake of U.S. Pat. No. 4,279,332 and the rail splice clamp of U.S. Pat. No. 2,256,192. Other special purpose tools are shown in U.S. Pat. Nos. 2,504,345, 2,566,454, 2,591,210, and 2,706,613.

DISCLOSURE OF INVENTION

The present invention is directed to apparatus enabling the controlled release of elevator hoist brakes. Such release is of advantage in emergencies requiring rescue of trapped passengers during a power outage as it allows the elevator car to be "drifted" to the nearest floor. The rescue is therefore effected promptly and without placing passengers or rescuers in dangerous situations (e.g. navigating from elevator car top to the nearest floor via ladders or ropes within the elevator shaft).

Apparatus in accordance with the invention are characterized by an elongate member and a lever rotatably mounted on structure that maintains the member and lever in spaced association. The lever defines two salient jaw portions spaced longitudinally and transversely on the lever. The lever further defines a pivot point between the jaw portions. Thus the lever can exert force, in cooperation with the elongate member, through the law portions to press brake arms apart or together as required by the class of elevators.

In a preferred embodiment the apparatus structure connecting the member and lever comprises elongate members and adjustable mounts therebetween which facilitate adjustment to the brake arm dimensions of a specific elevator. The structure also enables rearrangement of the apparatus or combination with collar shaped members to exert force on the armature to release brakes on a class of elevators that do not have accessible brake arms.

The novel features of the invention are set forth with particularity in the appended claims. The invention will be best understood from the following description when read in conjunction with the accompanying drawings.

MODES FOR CARRYING OUT THE INVENTION

When a power outage occurs, as during a natural catastrophe such as an earthquake or fire, elevators may be stopped between floors and automatically held there by spring actuated brakes associated with the hoist electrical motor at the top of the elevator shaft. During routine operation of the elevator, such brakes are typically released by a solenoid that opposes the spring force. This arrangement is designed for safety when electrical power is lost. Unfortunately, however, if passengers are in the elevator car it may be some time before they can be rescued. Such rescues often involve forcing the elevator hall doors and reaching the car below by ropes or ladders. This involves a certain amount of danger to both rescuers and passengers and requires availability of a fair number of rescue personnel. In the case of an earthquake such availability is severely limited due to the number of such emergencies and passengers may be trapped for a considerable time.

Elevator cars are usually attached to a cable that is rove over a pulley at the top of the elevator shaft and attached at the other end to a counterweight. The car and counterweight move up and down in separate guide rails within the shaft. The weight of the car is typically 40% of the counterweight. Even with several passengers the counter weight still outweighs the car so that, during a power outage, if the hoist brake were somehow released the car would "drift" upwards in the shaft. Thus if it were possible to release the brake in a controlled manner a car could be quickly drifted to the nearest floor. If, in addition, this could be effected by only one or two trained personnel, many passengers could be spared anguish, injury and even death during a natural catastrophe.

Figure 1:
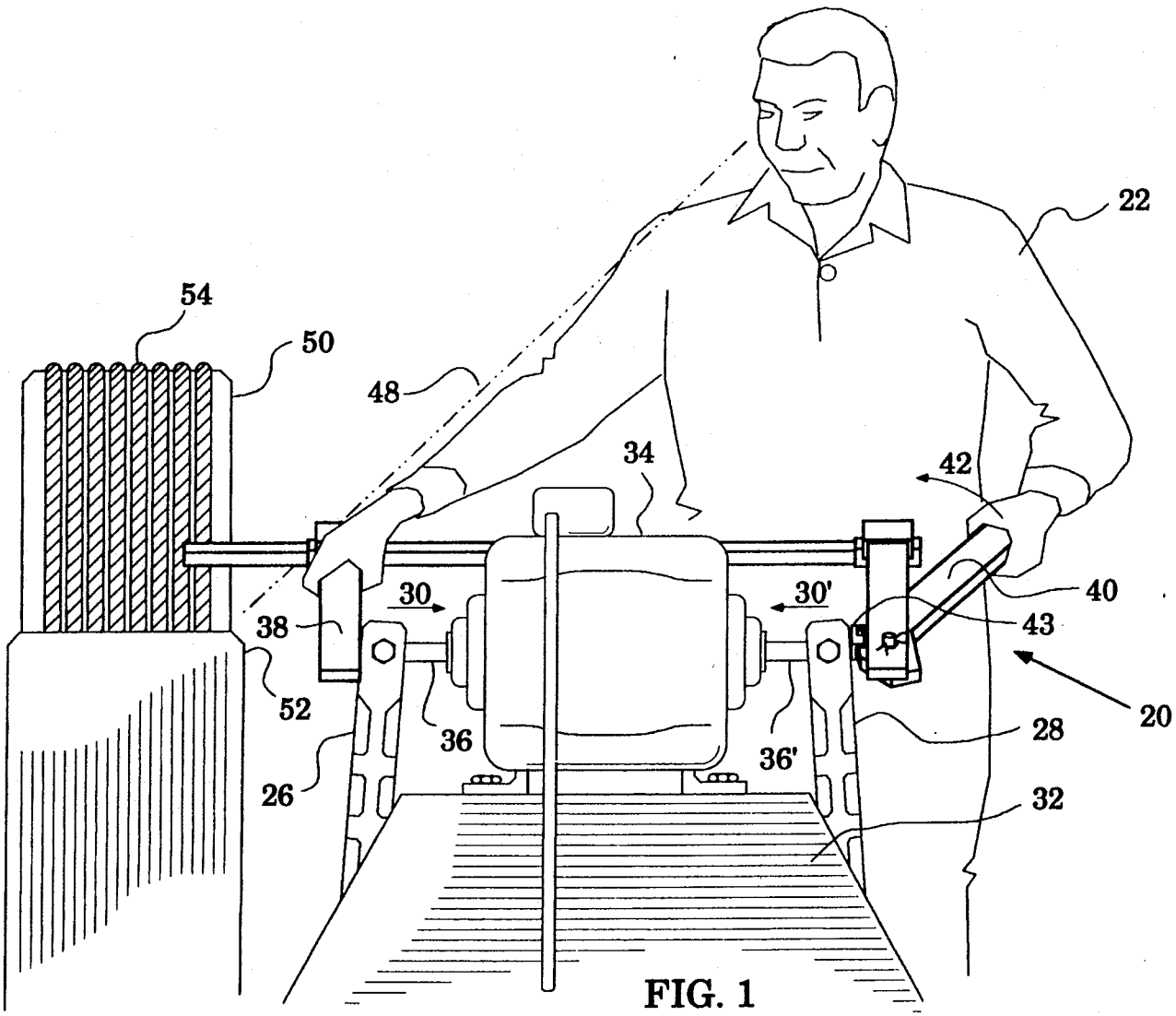
FIG. 1 is an elevation view of a brake release apparatus embodiment, in accordance with the present invention, employed by a operator thereof in a controlled release of an elevator hoist brake.

FIG. 1 is an elevation view illustrating an apparatus embodiment 20, in accordance with the present invention employed by a single operator 22 thereof to effect a controlled release of an elevator hoist brake located in the machine room above the top of the elevator shaft. With the class of elevator envisioned in FIG. 1, the brake is released by moving the brake arms 26, 28 inward as indicated by the arrows 30, 30' against the brake springs of the motor 32. As indicated above, in normal operation this movement is accomplished by the electrical solenoid 34 moving armature rods 36, 36' attached to the arms 26, 28.

In FIG. 1 the operator 22 positions the apparatus 20 to receive the arms 26, 28 between an elongated member 38 and a lever 40 of the apparatus 20. The operator then abuts the brake arms 26, 28 with, respectively, the member 38 and the lever 40 and, by moving one end of the lever 40 in the direction of the arrow 42, easily moves the brake arms inward (a rotatable clip 43 accommodates movement between the arm 28 and the lever 40). By watching (as indicated by the sight line 48) movement of the pulley 50 relative to the pulley housing 52, the operator can apply just enough force to the lever 40 to move the pulley 50 at a slow controlled rate.

One person located at the floor above the stalled elevator can open the elevator hall door, observe the elevator car location relative to the floor and communicate (e.g. with a hand held transceiver) instructions to the operator 22. Many elevator cables 54 are "roped" one to one meaning that a distance moved by the cable 54 on the pulley 50 is equal to the distance moved by the elevator car in the elevator shaft (the cable 54 is also rove several times about the pulley 50 as seen in FIG. 1 to prevent slippage therebetween). Thus, for example, the observer might tell the operator 22 to drift the car up 3 feet. The operator 22 would then exert pressure on the lever 40 and allow the pulley 50 to move approximately 3 feet relative to the housing 52.

Repeating this operation in increasingly shorter distance moves will bring the car sufficiently close to the next floor to allow the trapped passengers to simply step out of the car after the observer instructs them to push open the car doors. Thus with the aid of the apparatus 20, only two trained personnel can rescue trapped passengers in a few minutes (even in the case of several elevators in a large building). In addition such rescue is effected without placing rescuers or passengers in a dangerous situation.

Figure 2:
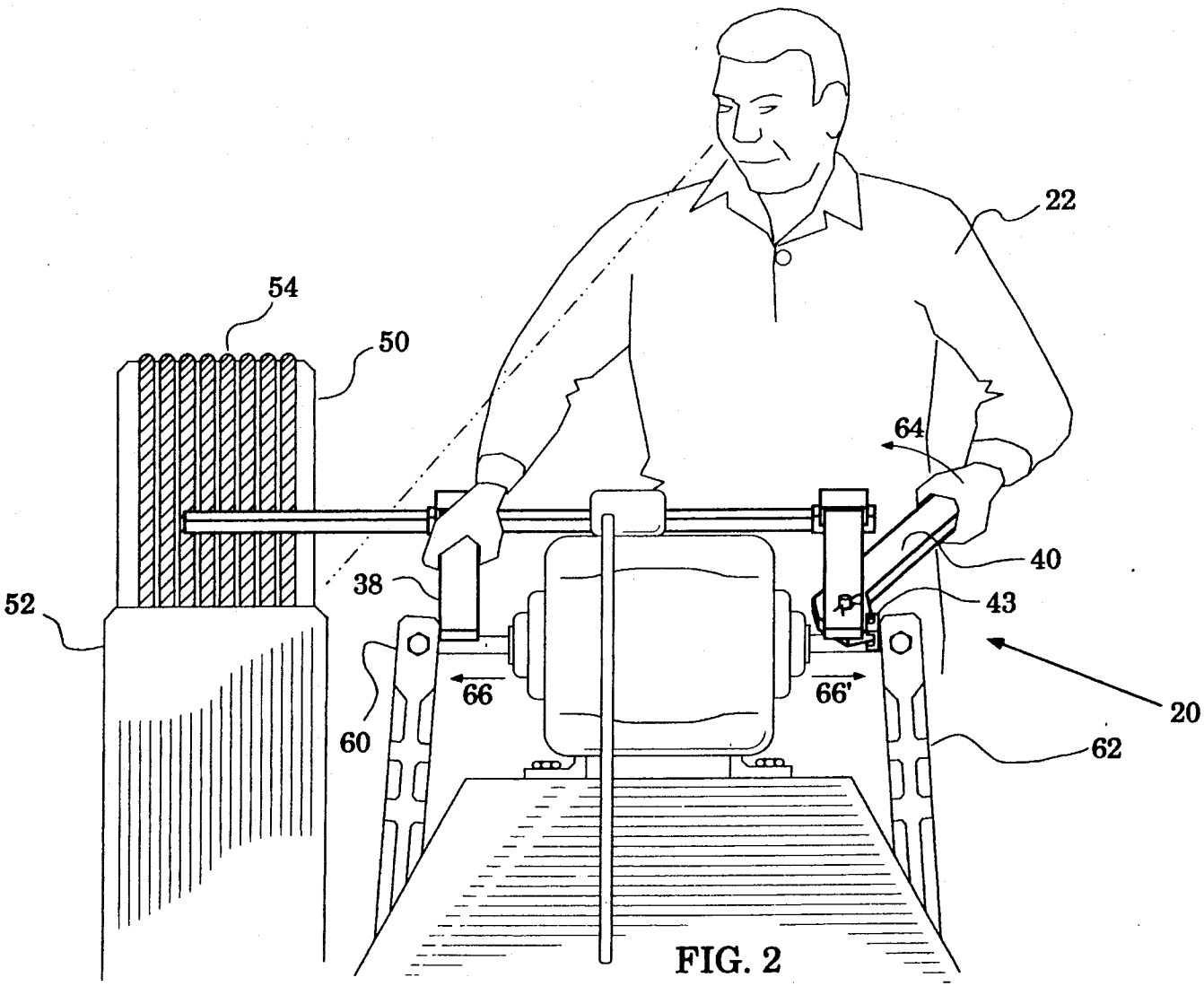
FIG. 2 is a view similar to FIG. 1 illustrating an alternate use of the apparatus of FIG. 1.

In a second class of elevators the hoist brake is released by moving the brake arms outward rather than inward as shown in FIG. 1. FIG. 2 is a view similar to FIG. 1 illustrating the use of the apparatus 20 for this class of elevators. The clip 43 has been moved transversely and longitudinally on the lever 40 and rotatably remounted to the lever 40. The operator 22 inserts the apparatus 20 between the brake arms 60, 62 to abut them with, respectively, the member 38 and the lever 40 (separated by the clip 43). The operator 22 then moves the lever 40 in the direction of the arrow 64 to force the arms in the directions 66, 66'. The remainder of the operation of drifting the elevator car is similar to that described relative to FIG. 1 above.

It was noted above that many elevators are "roped" in a one to one relationship between the car and the pulley. Other relationships (e.g. 2 to 1) also exist. The trained operator would be aware of this relationship and adjust the pulley movement accordingly.

Figure 3D:
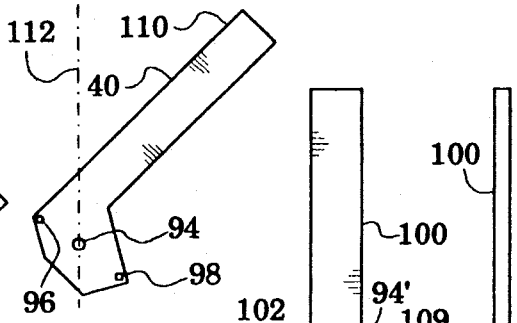
FIG. 3D is a plan view of the lever embodiment of FIG. 3A.
Figures 3E, 3F:
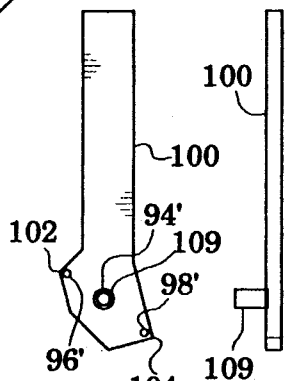
FIG. 3E is a plan view of another lever embodiment.
FIG. 3F is a side view of the lever embodiment of FIG. 3E.
Figure 3G:
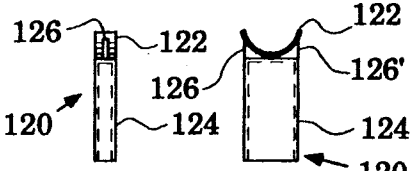
FIG. 3G is a side view of a tip to be used with part of the apparatus of FIG. 3A as another brake release apparatus embodiment.
Figure 3H:
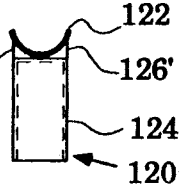
FIG. 3H is a plan view of the tip of FIG. 3G.
Figures 3J, 3K:
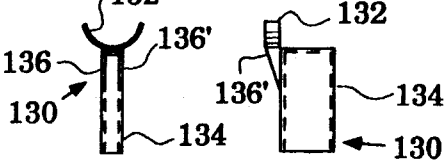
FIG. 3J is a side view of another tip to be used with part of the apparatus of FIG. 3A as another brake release apparatus embodiment.
FIG. 3K is a plan view of the tip of FIG. 3J.
Figure 3A:
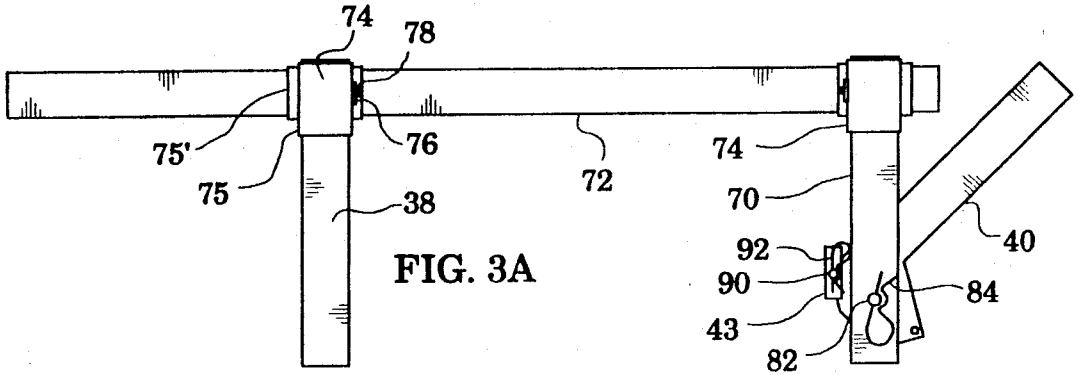
FIG. 3A is a top plan view of the apparatus of FIG. 1.
Figure 3B:
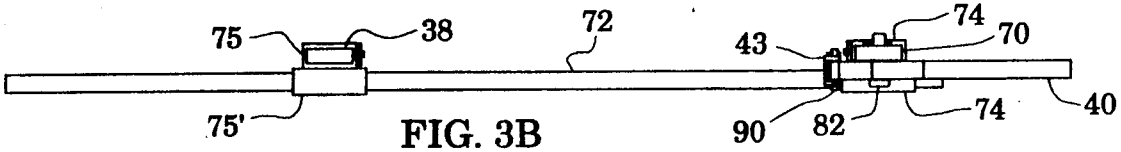
FIG. 3B is a side view of the apparatus of FIG. 3A.
Figure 3C:
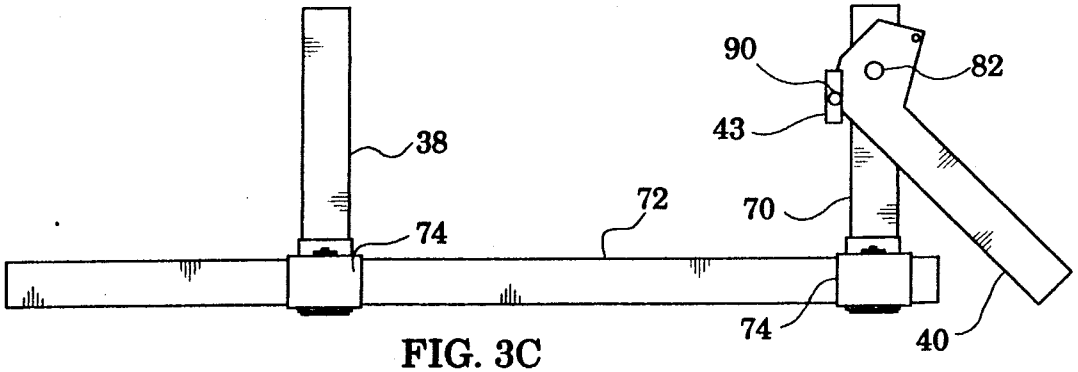
FIG. 3C is a bottom plan view of the apparatus of FIG. 3A.

FIGS. 3A, 3B and 3C are, respectively, top plan, side and bottom plan views of the apparatus 20 of FIG. 1 illustrating elongated aluminum members 38 and 70 held in substantially orthogonal association with an elongated aluminum member 72 by mounts 74. The mounts 74 each comprise two hollow rectangular aluminum tubes 75, 75' attached together (e.g. by welding) in orthogonal association to slidably receive the members 38, 70 and 72.

Doubler plates 78 are attached (e.g. by welding) to the tubes 75 thus adding wall thickness to receive allen screws 80 that abut the members within the mounts to hold them in place relative to the mounts. Thus the members 38, 70 and 72 may be slidably adjusted through the mounts 74 to a configuration conforming to the dimensions of the brake arms (26, 28 in FIG. 1) and locked in that configuration with the allen screws 80.

The lever 40 is rotatably mounted with a headed pin 82 to the member 70 and the pin is secured with a quick release cotter pin 84. Similarly the U shaped clip 43 is rotatably mounted to the lever 40 with a headed pin 90 and quick release cotter pin 92. The pins 82, 90, quick release cotter pins 84, 92, allen screws 80 and mounts 74 enable the disassembly of the apparatus 20 into separate parts which may then easily be stored or shipped. Assembly is a matter of a few minutes and adjustment to conform to a specifically dimensioned set of brake arms is quickly accomplished without the use of special tools.

FIG. 3D is a plan view of the lever 40 illustrating that it defines a hole 94 for receiving the pin 82 and holes 96, 98 for receiving the pin 90. The other features of the lever 40 can best be understood after a description of another lever embodiment 100 shown in FIGS. 3E and 3F. The lever 100 defines, proximate a first end of the lever 100, similar holes 94', 96' and 98' and also defines salient jaw portions 102, 104. The salient jaw portions 102, 104 are spaced apart longitudinally and transversely on the lever 100. The hole 94' which defines a pivot axis about which the lever 100 rotates, is spaced between the jaw portions 102, 104. It is important to note that the salient jaw portions 102, 104 protrude, relative to the hole 96', from the general lever outline.

Thus if the lever 100 is used in place of the lever 40 on the apparatus 20, shown in FIG. 3A, it may be seen that the jaw portion 102 and the jaw portion 104 move outward relative to the member 70 as the lever 100 is rotated counterclockwise (similar to the direction 42 in FIG. 1). Thus the jaw portions 102, 104 can be used to abut and move brake levers as in FIGS. 1 and 2.

The longitudinal and transverse spacing of the jaw portions 102, 104 insures that one is available for pressing brake arms together as in FIG. 1 and the other is available for pressing brake arms apart as in FIG. 2. The clip 43 accommodates relative movement between the jaw portions and the brake levers. The side view of FIG. 3F illustrates a spacer 109 which is required so that the lever 100 will clear the other portions of the apparatus 20 when the lever 100 replaces the lever 40 (a longer pin 82' would also be used for this apparatus embodiment; alternatively the lever 100 could be mounted with a shorter spacer and pin above rather than below member 70 in FIG. 3A).

Returning to the lever embodiment 40 of FIG. 3D it will now be appreciated that the lever 40 differs from the lever embodiment 100 only in that a second end 110 of the lever 40 is offset from the effective longitudinal lever axis 112. The purpose of this offset end 110 is to facilitate manipulation of the lever 40 as is best seen in FIGS. 1 and 2. Because of the offset end 110 the lever 40 does not require a spacer.

FIGS. 3G, 3H, 3J and 3K illustrate further elements that can be used to modify the apparatus 20 for use in a class of elevators that do not have accessible brake arms. The tip 120 comprises a collar 122 attached to a hollow shell 124 with gussets 126, 126'. The tip 130 has a similar collar 132, shell 134 and gussets 136, 136' but has the collar arranged parallel to the minor axis of the shell rather than the major axis as in the tip 120. The shells 124, 134 are dimensioned to slip onto the end of one of the elongate members 38, 70 or 72 of the apparatus 20 of FIG. 3A and the collars 122, 132 are dimensioned to accommodate elevator brake armature rods.

Figure 4:
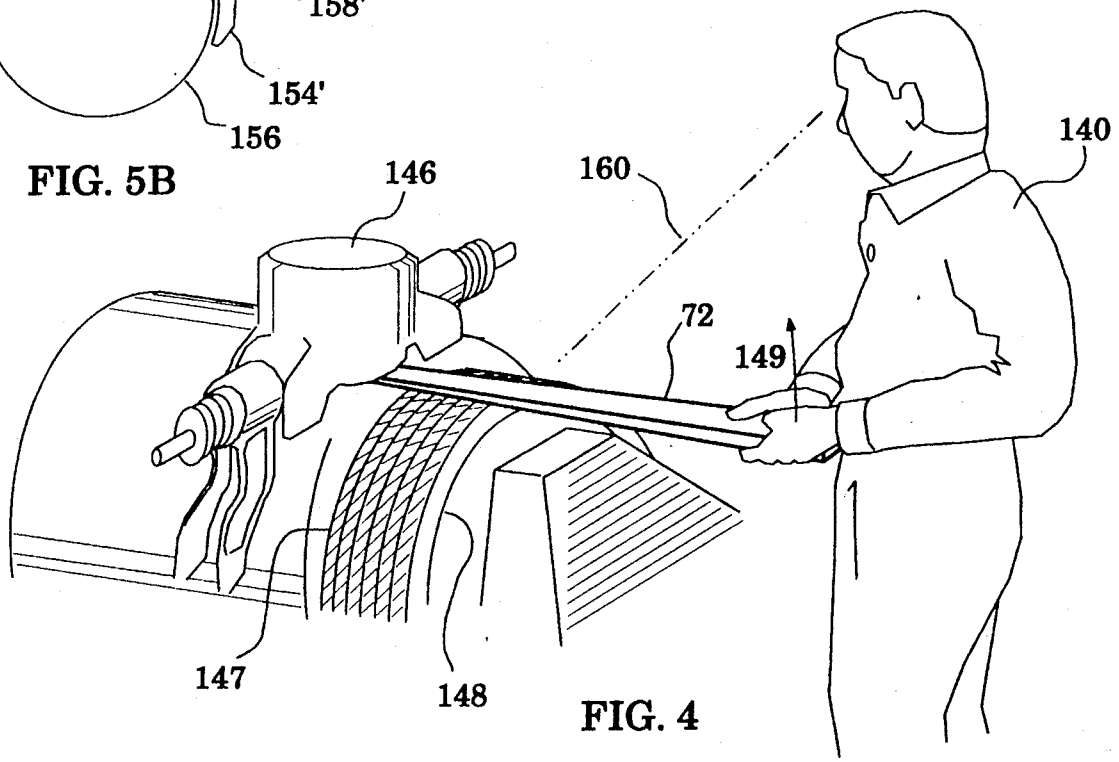
FIG. 4 is a perspective view of another brake release apparatus embodiment employed by an operator thereof in a controlled release of an elevator hoist brake.
Figure 5B:
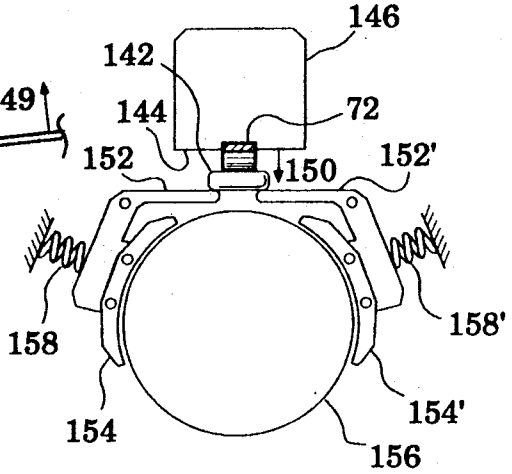
FIG. 5B is a view along the plane 5B—5B of FIG. 5A.
Figure 5A:
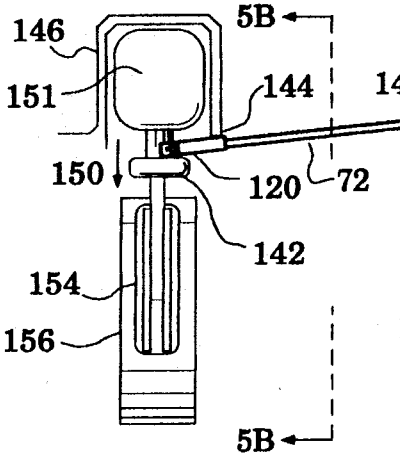
FIG. 5A is a side elevation view of the apparatus and brake of FIG. 4.

As mentioned above there is a third class of elevators that do not have accessible brake arms but do have accessible solenoid armatures. The controlled release of such an elevator brake is illustrated in FIGS. 4, 5A and 5B where a operator 140 is using the tip 120 (of FIGS. 5G and 5H) over the end of the member 72 (of the apparatus 20 of FIG. 3A). In these FIGURES it is seen that the operator 140 has abutted the brake armature rod 142 with the collar 122 and caused the member 72 to abut the rim 144 of the solenoid case 146. The member 72 is above and free of the elevator cable 147 and pulley 148.

When the operator 140 exerts force upward on the end of the member 72 as indicated by the arrow 149 the armature rod 142 is moved downward as indicated by the arrow 150. This movement (which would be the normal solenoid movement effected by the electromagnet coil 151 if electrical power were available) against the brake levers 152, 152' causes the brake shoes 154, 154' to be pressed away from the brake drum 156 against the urging of the brake springs 158, 158'. The operator watches the elevator pulley 148 (as indicated by the sight line 160) to observe how far the elevator has drifted in the elevator shaft.

Figure 6A:
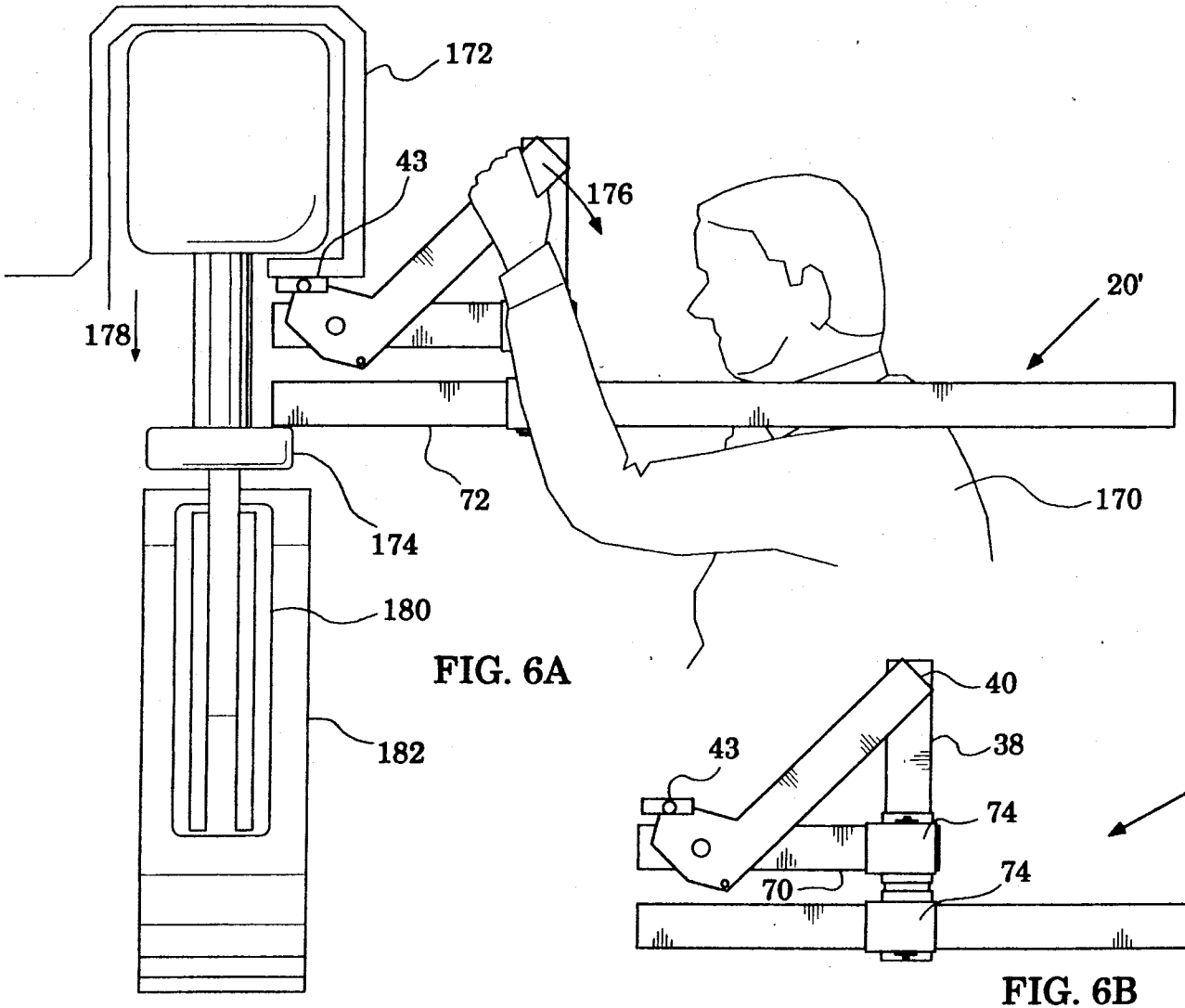
FIG. 6A is an elevation view illustrating an alternate arrangement and use of the apparatus of FIG. 1.
Figure 6B:
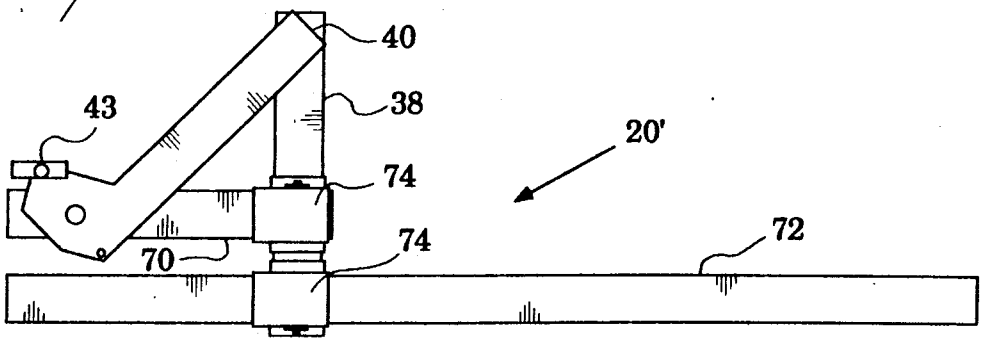
FIG. 6B is an elevation view of the apparatus arrangement of FIG. 6A.

Some elevators of this third class are dimensioned such that the tip 130 (FIGS. 3J, 3K) is more useful than the tip 120 in the use illustrated in FIGS. 4, 5A and 5B. Still other elevators of this class are dimensioned too large for either of the tips 120, 130. For these elevators he apparatus 20 of FIG. 3A may be rearranged to the apparatus 20' as shown in FIGS. 6A and 6B. In the apparatus 20' members 38 and 72 have been interchanged.

In FIG. 6A the operator 170 has mounted the apparatus 20' on his shoulder and abutted the armature shell 172 and armature rod 174 with, respectively, the clip 43 and the member 72. When the operator 170 exerts force downward as indicated by the arrow 176, the armature rod 174 is moved downward as indicated by the arrow 178 to disengage the brake shoes 180 from the drum 182.

Thus it should be apparent that apparatus embodiments have been disclosed herein enabling the controlled release of an elevator brake for drifting an elevator car within an elevator shaft to effect rescue of stranded passengers during an electrical outage. Apparatus in accordance with the invention may be used with several classes of elevators. Although the apparatus embodiments disclosed herein utilize aluminum bar stock and extrusions, allen screws and cotter pins in their construction it will be understood that numerous construction variations may be made without departing from the spirit of the invention.

The apparatus embodiments depicted herein are exemplary and numerous modifications and rearrangements can be made with the equivalent result still embraced within the scope of the invention.

What is claimed is:

1. A method of releasing an elevator hoist brake having brake shoes responsive to movement of brake arms against the urging of brake springs, the method comprising the steps of:

providing an elongate lever;

defining, proximate to a first end of said lever, a salient jaw portion;

providing an abutment member;

providing a support member; pivoting said lever on said support member about a pivot axis on said lever spaced longitudinally from said jaw portion;

mounting said abutment member on said support member in a spaced relationship with said lever;

abutting one of said brake arms with said abutment member;

abutting another of said brake arms with said jaw portion; and applying force to a second end of said lever to move said brake arms relative to said urging of said brake springs.

2. A method as defined in claim 3, further comprising the steps of:

monitoring elevator car velocity in response to movement of said brake arms; and adjusting the magnitude of said force to limit said velocity.

3. A method as defined in claim 1, further comprising the step of adjusting said spaced relationship between said abutment member and said lever to facilitate said abutting steps.

4. A method as defined in claim 1, further comprising the step of providing a rotatably mounted clip to said jaw portion in said jaw abutting step to facilitate abutment therewith.

5. A method of releasing an elevator hoist brake having brake shoes responsive to movement of brake arms against the urging of brake springs, the method comprising the steps of:

providing a lever elongated along a longitudinal axis;

defining, proximate to a first end of said lever, salient first and second jaw portions spaced longitudinally on said lever;

providing an abutment member;

providing a support member;

pivoting said lever on said support member about a pivot axis of said lever located between said first and second jaw portions;

mounting said abutment member on said support member in a spaced relationship with said lever;

abutting one of said brake arms with said abutment member;

abutting another of said brake arms with one of said first and second jaw portions; and applying force to the second end of said lever to move said brake arms relative to said urging of said brake springs.

6. A method of releasing an elevator hoist brake having brake shoes responsive to movement of an armature rod relative to an armature shell, the method comprising the steps of:

providing an elongate lever;

defining, proximate to a first end of said lever, a salient jaw portion;

providing an abutment member;

providing a support member;

pivoting said lever on said support member about a pivot axis on said lever spaced longitudinally from said jaw portion;

mounting said abutment member on said support member in a spaced relationship with said lever;

abutting one of said armature rod and said armature shell with said abutment member;

abutting the other of said armature rod and said armature shell with said jaw portion; and applying force to a second end of said lever to move said armature rod relative to said armature shell.

7. A method as defined in claim 6 further comprising the steps of: monitoring elevator car velocity in response to movement of said armature rod; and adjusting the magnitude of said force to limit said velocity.

8. A method as defined in claim 6 further comprising the step of adjusting said spaced relationship between said abutment member and said lever to facilitate said abutting steps.

9. A method as defined in claim 6 further comprising the step of providing a rotatably mounted clip to said jaw portion to facilitate abutment therewith.

10. A method of releasing an elevator hoist brake having brake shoes responsive to movement of an armature rod relative to an armature shell, the method comprising the steps of:

providing a lever elongated along a longitudinal axis;

defining, proximate to a first end of said lever, salient first and second jaw portions spaced longitudinally on said lever;

providing an abutment member;

providing a support member;

pivoting said lever on said support member about a pivot axis on said lever located between said first and second jaw portions;

mounting said abutment member on said support member in a spaced relationship with said lever;

abutting one of said armature rod and said armature shell with said abutment member;

abutting the other of said armature rod and said armature shell with one of said first and second jaw portions; and applying force to the second end of said lever to move said armature rod relative to said armature shell.

* * * * *